United States Patent [19]

O'Connor

[11] Patent Number: 4,546,819

[45] Date of Patent: Oct. 15, 1985

[54] DOUBLE WALL HEAT EXCHANGER

[75] Inventor: Robert E. O'Connor, Greenville, R.I.

[73] Assignee: Amtrol Inc., West Warwick, R.I.

[21] Appl. No.: 579,170

[22] Filed: Feb. 10, 1984

[51] Int. Cl.[4] ..... F28F 11/00

[52] U.S. Cl. ..... 165/70; 126/446; 165/141; 165/179; 165/184

[58] Field of Search ..... 165/70, 179, 184, 134, 165/140, 141, 180; 126/446

[56] References Cited

U.S. PATENT DOCUMENTS

| | | | |
|---|---|---|---|
| 1,646,384 | 10/1927 | Bergstrom | 29/157.3 A |
| 1,813,096 | 7/1931 | Stenner | 29/157.3 A |
| 1,865,575 | 7/1932 | Locke | 72/97 |
| 1,909,005 | 5/1933 | Paugh | 29/157.3 A |
| 1,970,481 | 8/1934 | Young et al. | 29/157.3 A |
| 2,586,653 | 2/1952 | Hill | 29/157.3 AH |
| 2,693,026 | 11/1954 | Simpelaar | 29/157.3 A |
| 2,724,979 | 11/1955 | Cross | 29/157.3 AH |
| 2,913,009 | 11/1959 | Kuthe | 138/38 |
| 3,100,930 | 8/1963 | Nihlen et al. | 29/157.3 AH |
| 3,267,563 | 8/1966 | Seaton | 29/157.3 A |
| 3,267,564 | 8/1966 | Keyes | 29/157.3 |
| 3,467,180 | 9/1969 | Pensotti | 165/180 |
| 3,724,537 | 4/1973 | Johnson | 165/133 |
| 3,730,229 | 5/1973 | D'Onofrio | 138/114 |
| 3,750,444 | 8/1973 | Bittner | 72/78 |
| 3,777,343 | 12/1973 | D'Onofrio | 29/157.3 R |
| 3,868,754 | 3/1975 | Kawano | 29/157.3 A |
| 3,878,593 | 4/1975 | Owen | 29/157.3 A |
| 3,887,004 | 6/1975 | Beck | 165/179 |
| 4,031,602 | 6/1977 | Cunningham et al. | 29/157.3 AH |
| 4,111,402 | 9/1978 | Barbini | 366/338 |
| 4,153,982 | 5/1979 | Przybla et al. | 29/157.3 |
| 4,210,199 | 7/1980 | Doucette et al. | 165/70 |
| 4,217,886 | 8/1980 | McLaughlin | 126/446 |
| 4,312,207 | 1/1982 | Przybla et al. | 72/100 |
| 4,337,824 | 7/1982 | Kirk | 165/70 |
| 4,372,374 | 2/1983 | Lee | 165/70 |
| 4,372,375 | 2/1983 | Bond | 165/70 |
| 4,403,385 | 9/1983 | Kirk | 29/157.3 AH |

FOREIGN PATENT DOCUMENTS

| | | | |
|---|---|---|---|
| 2016991 | 4/1971 | Fed. Rep. of Germany . | |
| 2803365 | 7/1978 | Fed. Rep. of Germany | 29/157.3 A |
| 960628 | 6/1964 | United Kingdom | 165/70 |
| 434252 | 10/1974 | U.S.S.R. | 165/180 |

OTHER PUBLICATIONS

English Translation of German O.S. 2016991.

Reed Manual, 54 pp., Describing Reed Cylindrical Die Thread Roll Machines.

*Primary Examiner*—Sheldon J. Richter

*Attorney, Agent, or Firm*—Fisher, Christen & Sabol

[57] ABSTRACT

A double wall heat exchanger for use in solar heaters and the like. An outer drawn copper tube of predetermined thickness and inside diameter is slid over a second drawn copper tube also of a predetermined thickness and outside diameter. A small axial groove, which is parallel to the longitudinal axis of the second or inner tube, is located in the surface of the inner tube and extends the entire length of the inner tube. The tubes are then placed in a furnace and annealed for a specified time and temperature. The double wall tubes are placed in a finning machine. Under a specified pressure and at a specified feed rate, integral fins are formed on the outside tube. While the fins are being formed on the outside tube, internal pressure is being applied forcing the inner tube to expand and conform to the inside diameter of the outer tube. The mating surfaces form a helical passageway which serves as part of the path of leakage. The axial groove communicates with each winding of the helical passageway and substantially shortens the total leakage path, thereby reducing the pressure differential needed to produce evidence of leakage in a given time period. The double wall heat exchanger has good surface between the tubes, has a path of leakage between the tubes at a pressure differential of as low as 3 psig, and has good heat transfer. The axial groove is small enough so as to have little effect on the overall heat transfer rate, but is of sufficient size so as to provide a leak rate that meets the requirements of the installation.

18 Claims, 9 Drawing Figures

DOUBLE WALL HEAT EXCHANGER

BACKGROUND OF THIS INVENTION

1. Field of This Invention

This invention relates to double wall heat exchangers and methods of preparing such double wall heat exchangers.

2. Prior Art

Due to the possible toxicity of solar fluids, several codes of state and local governments have been enacted which require the heat exchanger tube coil to have two separate walls. The design of such double wall heat exchangers can be of two basic types, namely, vented and unvented. With the vented design, a failure of the inner coil will cause leakage at the terminal ends of the coil at a specified pressure (about 10 psig) between the tubes. With the unvented design, the terminal ends of the coil are sealed. The placing of one tube inside of another has been done in the past; however, in such cases, there is little or no metal contact surface between the tube walls resulting in poor heat transfer. The art has tried more elaborate schemes which have also been unsatisfactory.

BROAD DESCRIPTION OF THIS INVENTION

An object of this invention is to provide an improvement in the double wall heat exchangers which have a helical passageway between the inner tube and outer tube thereof. Another object of this invention is to provide a double wall heat exchanger which has excellent heat transfer between the inner tube and outer tube thereof. A further object of this invention is to provide a double wall heat exchanger which has a shortened path of leakage between the tubes at a pressure differential of 5 psig. Another object of this invention is to provide a process for the preparation of such double wall heat exchangers, such process having reduced cost of manufacture. Other objects and advantages of this invention are set out herein or are obvious herefrom to one ordinarily skilled in the art.

The objects and advantages of this invention are achieved by the double wall heat exchanger and processes of this invention.

This invention provides an improvement in the double wall heat exchangers which have a helical passageway between the inner tube and outer tube thereof. The invention double wall heat exchanger is useful for solar heaters and the like. The heat exchanger includes an outer tube having an outer helical fin and a small helical groove on the inside of the outer tube. The helical groove follows the helical path of the outer helical fin. There in an inner tube which has a small axial groove located on its outer perimeter. The inner tube has a slightly-raised continuous helical protrusion which matches the path of the inner helical groove of the outer tube. A narrow helical passageway between the inner tube and outer tube is formed by the mating of the small helical groove and the slightly-raised continuous helical protrusion. The inner surface of the outer tube, except in the region of the inner small helical groove thereof and in the region of the axial groove of the inner tube, contacts the outer surface of the inner tube, except in the region of the slightly-raised continuous helical protrusion and axial groove thereof.

An outer drawn copper tube of a predetermined thickness and inside diameter is slid over a second drawn copper tube also of a predetermined thickness and outside diameter. A small, axial groove, which is parallel to the longitudinal axis of the second or inner tube, is located in the surface of the inner tube and extends the entire length of the inner tube. The tubes are then placed in a furnace and annealed for a specified time and temperature. The double wall tubes are placed in a finning machine. Under a specified pressure and at a specified feed rate, integral fins are formed on the outside tube. While the fins are being formed on the outside tube, internal pressure is being applied forcing the inner tube to expand and conform to the inside diameter of the outer tube. The mating surfaces form a helical passageway which serves as part of the path of leakage. The axial groove communicates with each winding of the helical passageway and substantially shortens the total leakage path, thereby reducing the pressure differential needed to produce evidence of leakage in a given time period. The double wall heat exchanger has good surface contact between the tubes, has a path of leakage between the tubes at a pressure differential of 3 psig, and has good heat transfer. The production process provides reduced cost of manufacture, improved heat transfer and the safety feature required by the various state and local codes. The axial groove is small enough so as to have little effect on the overall heat transfer rate, but is of sufficient size so as to provide a leak rate that meets the requirements of the installation.

There is excellent heat exchange between the inner and outer tubes of this invention. The double wall heat exchanger has at least 96 percent metal-to-metal surface contact between the inner and outer tubes.

Preferably the axial groove of the inner tube is rectangular in lateral cross-section, and preferably has a width of 0.015 inch and a depth of 0.015 inch. The dimensions and lateral cross-sectional shape of the axial groove of the inner tube can be any which are effective in providing a shortened leak path, in providing a leak path between the tubes at a pressure differential of as little as 3 psig and in not impairing the heat transfer. The axial groove can have a lateral cross-sectional shape which is, for example, semicircular, vee-shaped, semi-eliptical, etc. The axial groove typically has a width of 0.005 to 0.02 inch and a depth of 0.003 to 0.02 inch. The axial groove should only take up a small percentage of the outer surface of the inner tube.

Preferably the axial groove extends the entire length of the inner tube.

The helical continuous passageway between the inner and outer tubes typically has a height of 0.002 to 0.003 inch. The height of the helical passageway can be varied by the amount of the prior annealing of the inner tube (or by using a softer metal for the inner tube). The more the prior annealing, the more the height of the passageway. The helical passageway takes up 2 percent or less of the surface area of the outer surface of the inner tube (or of the outer tube). If the percentage is more than 2 percent, heat transfer capacity is lost—dead air space the following cross-section: 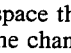 . The size of the channel can be varied by varying the clearance between the inner and outer tubes. A tighter clearance means a smaller sized channel.

Preferably the double wall heat exchanger is prepared from previously annealed copper. Any other suitable material can be used-any metal can be rolled to form the fins, etc., as long as the rolls are harder than the rolled material, particularly the outer tube. For example, double wall heat exchangers for nuclear reactors can be preapred using a copper outer tube and a stainless steel inner tube. The inner and outer tubes can be made of the same or different metals provided the metal or metals are ductible enough to be rolled or finned.

The double wall heat exchangers of this invention preferably exclude internal fins since such internal fins cause a major fluid flow pressure drop, etc., in the passageway of the inner tube.

The process of this invention for preparing the double wall heat exchanger broadly includes placing an outer tube of a predetermined thickness and inside diameter over a second tube (having a small axial groove) also of a predetermined thickness and outside diameter. The material of the tubes is preferably drawn to copper, but other materials can be used. The tubes are then placed in a furnace and annealed for a specified time and temperature. The double wall tubes are placed in a finning machine with a mandrel inside of the inner tube. Under a specified pressure and at a specified feed rate, integral fins are formed on the outside tube. While the fins are being formed on the outside tube, internal pressure is being applied forcing the inner tube to expand and conform to the inside diameter of the outer tube. The mating surfaces form a helical passageway which, together with the axial groove of the inner tube, serves as the leakage path. Each set of roller dies is set at a slightly canted angle (such as, two degrees, fifteen minutes)—that is well known procedure in the art.

A mandrel is normally inserted into the internal passageway of the inner tube during the rolling or finning step.

The double wall heat exchanger can be formed into coils having a diameter as small as three inches.

The outer tube has a slightly larger inner diameter than the outer diameter of the inner tube so that the inner tube can be inserted into the outer tube. The difference in such diameters is usually in the range of say 0.007 to 0.010 inches. The main factors are that the inner tube can easily be inserted into the outer tube without there being much play between the inner and outer tubes. During rolling, the inner tube is expanded by the applied internal pressure to conform to the shape and inner diameter of the outer tube (the internal helical tube thereof is not completely filled by the expanding inner tube). The inner tube in the region of its axial groove tube is not expanded to conform to the shape and diameter of the outer tube.

The helical passageway (i.e., annular space) between the inner tube and the outer tube is helically shaped. The helical groove in the bottom of the outer tube is continuous. The helical passageway is interrupted each rotation of it over The helical passageway is interrupted each rotation of it over the axial groove. Both ends of each rotation of the helical passageway communicate in an unrestricted manner with the axial groove. The complex of the helical passageway (or spiral groove) and axial groove can be vented (i.e., open on one or both ends) or unvented (i.e., closed on both ends). The helical passageway and the axial groove provide a path of leakage between the tubes at a pressure differential of as little as 3 psig. This means that if the inner tube ruptures or develops a leak, there is a passageway to drain off the leaking internal fluid to a safe collection point without the internal fluid mixing with the external fluid (e.g., household bath and drinking water).

The process of this invention involves rolling to form the fins, etc., and does not involve forming the fins by the technique of twisting the tube.

By way of summary, the design of the invention double wall tubing will provide evidence of any leakage of the tubing. The invention design improves the leak path of an annular helical leak path by the addition of a groove axially along the inner tube which communicates with the helical annular leak paths. A rectangular cross-section is preferred, but any convenient and effective shape of the groove can be used. The dimensions of the groove or axial leak path are dictated by the length of the double wall tubing, but are of sufficient size to provide a leak rate that meets the requirements of the installation. The advantages of the invention are obvious to those knowledgeable in the field. First, and foremost, there is a substantial reduction in the length of the leak path with a reduction in the pressure of time. Additionally, there is little negative effect on the heat transfer rate and on the advantage of ease of manufacture when using this invention.

BRIEF DESCRIPTION OF THE INVENTION

Figure 1:
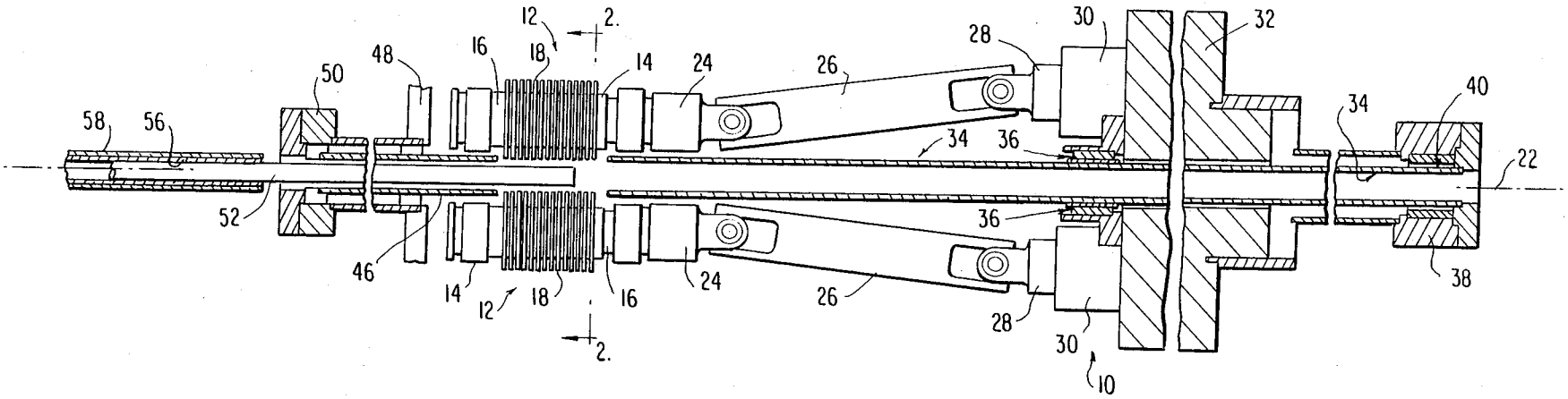
FIG. 1 is a partially cutaway, schematic, side elevational view of the equipment for carrying out the process of this invention for forming the double wall heat exchanger of this invention.
Figure 2:
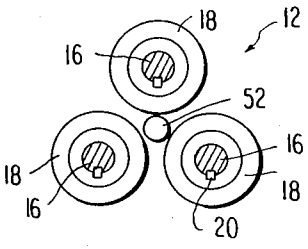
FIG. 2 is a sectional view along line 2—2 in FIG. 1 of the forming discs and the mandrel.
Figure 4:
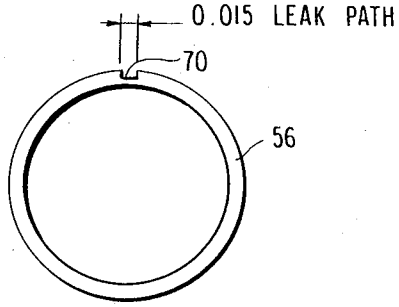
FIG. 4 is a front cross-sectional view of the inner tube showing the axial groove.

In FIG. 1, numeral 10 is a rib-forming apparatus which uses a set of three roller die assemblies 12. (Rib-forming apparatus 10 can typically be a Reed cylindrical die thread rolling machine where the die is a set of three roller die assemblies 12. Any other suitable thread rolling or rib forming machine can be used.) Each roller die assembly 12 includes double-support die holder body 14, rod 16 and roller dies 18 mounted on rod 16. Rod 16 is rotatably mounted in die holder body 14 as best shown in FIG. 4. Key pin 20 holds roller die 18 in place on rod 16. The three roller die assemblies 12 are mounted so as to be spaced about 120° apart around central axis 22.

Each Y-mounting 24 located on the end of a rod 16 forms a universal joint with a universal joint connector 26. A Y-mounting 28, located on the rotatable shaft of a drive means 30, forms a universal joint with a universal joint connector 26. Housing 32 contains central passageway in which it is located near guide tube 34. Anti-friction bearings 36 are located around rear guide tube 34 and are mounted in the front end of housing 32. FIG. 1 shows extension support 38 which is used when long double wall heat exchangers are formed. Anti-friction bearings 40 are located around rear guide tube 34 and are mounted in extension support 38. The longitudinal axis of rear guide tube 34 coincides with central axis 22. Rear guide tube 34 extends almost to the outermost roller die 18 (i.e., roller die N), but far enough away therefrom so as not to interfere with the formation of fins 42 of double wall heat exchanger 44. Front guide tube 46 is mounted in back of housing 48. The longitudinal axis of front guide tube 46 coincides with central axis 22. Rear guide tube 46 extends almost to the innermost roller die 18 (i.e., roller die A), but far enough away therefrom so as not to interfere with the operation of roller dies 18. FIG. 1 shows extension support 50 which is used when long tubing is fed into rib-forming apparatus 10. The front end of rear guide tube 46 is mounted in extension support 50.

Each roller die assembly 12 contains fourteen roller dies 18 (i.e., roller dies A to N). Each successive roller die A to C is longer. Roller dies C to L are of the same length, with roller die M being longer and roller die N being slightly shorter.

Figure 3:
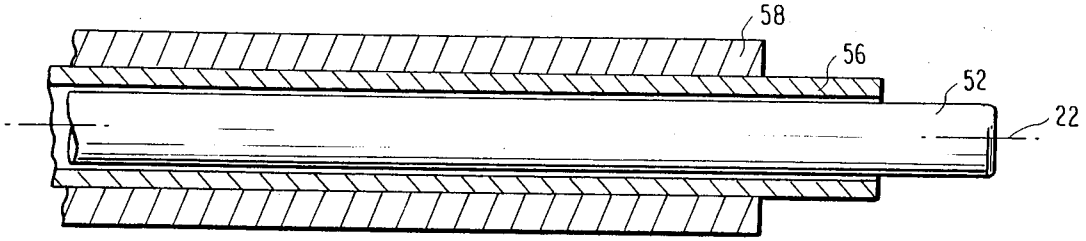
FIG. 3 is a side cross-sectional view of the inner tube inserted in the outer tube in place on the mandrel.
Figure 5:
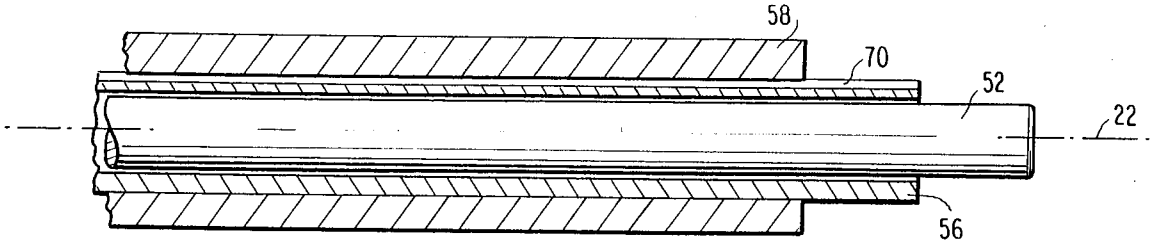
FIG. 5 is similar to FIG. 3, but is a side cross-sectional view of the inner tube, along the center of the axial groove, inserted in the outer tube in place on the mandrel.

Mandrel 52 extends through front guide tube 46. The end of mandrel 52 is rounded or bevelled (54). The end of mandrel 52 before the bevel extends between roller die assemblies 12 as far as the approximate middle of roller die L. As shown in FIG. 4, inner tube 56 has axial groove 70 located on its outer surface. As shown, the axial groove has a width of 0.015 inch and a depth of 0.015 inch. Inner tube 56 fits over mandrel 52 and is slidable thereover mandrel 52. Outer tube 58 tightly fits over inner tube 56. FIG. 3 shows outer tube 58 fit on inner tube 56 which is fit on mandrel 52. FIG. 5 is the same as FIG. 3 except that it is cut along the center of axial groove 70 of inner tube 56. The longitudinal axis of each of mandrel 52, inner tube 56, axial groove 70 and outer tube 58 coincides with central axis 22.

In a typical embodiment, as shown in FIGS. 3 to 8 outer tube 58 has an inside diameter of 0.604 inch and a wall thickness of 0.068 inch. Inner tube 56 has a wall thickness of 0.030 inch, and axial groove 70 has a depth and width of 0.015 inch. The diameter of mandrel 52 is about 0.570 inch, leaving a clearance between mandrel 52 and inner tube 56 of about 0.004 inch. The following data identifies roller dies 18:

| Roller Die | Overall Diameter, Inches | Vertical Wall Slope[1], degrees | X[2] Inch | R[3] Inch | Y[4] Inch |
|---|---|---|---|---|---|
| A | 2.725 | 12½ | 0.023 | 0.025 | 0.043 |
| B | 2.735 | 12½ | 0.021 | 0.025 | 0.040 |
| C | 2.750 | 12½ | 0.021 | 0.025 | 0.040 |
| D | 2.750 | 11½ | 0.022 | 0.025 | 0.042 |
| E | 2.750 | 10½ | 0.025 | 0.025 | 0.051 |
| F | 2.750 | 9½ | 0.025 | 0.025 | 0.054 |
| G | 2.750 | 8½ | 0.025 | 0.025 | 0.057 |
| H | 2.750 | 7½ | 0.025 | 0.025 | 0.060 |
| I | 2.750 | 7 | 0.025 | 0.025 | 0.062 |
| J | 2.750 | 6 | 0.025 | 0.025 | 0.065 |
| K | 2.750 | 5 | 0.025 | 0.025 | 0.068 |
| L | 2.750 | 5 | 0.025 | 0.025 | 0.068 |
| M | 2.810 | 5 | 0.025 | 0.025 | 0.067 |
| N | 2.743 | 5 | 0.025 | 0.025 | 0.067 |

Notes

1. The vertical wall slope measures the angle from the vertical for each lower side of the particular roller die.

2. X is the distance from the pivot points of the two Rs for each roller die to the horizontal cut off section of the bottom of each roller die. See FIG. 7.

Figure 7:
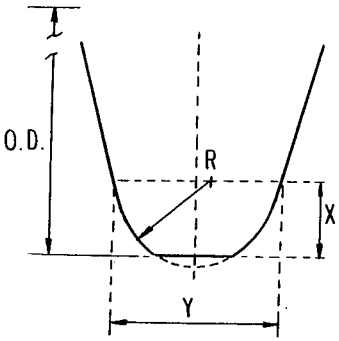
FIG. 7 is a profile view of roller dies A to D, but is also representative of the other roller dies.

3. R is a radius of 0.025 inch in all cases, i.e., for all of the roller dies. Each bottom edge of each roller die has a radius R. FIG. 7 is a profile view of roller dies E to N, each of the two Rs are further apart from each die thereby giving such roller dies blunter ends. For details, see FIG. 6.

Figure 6:
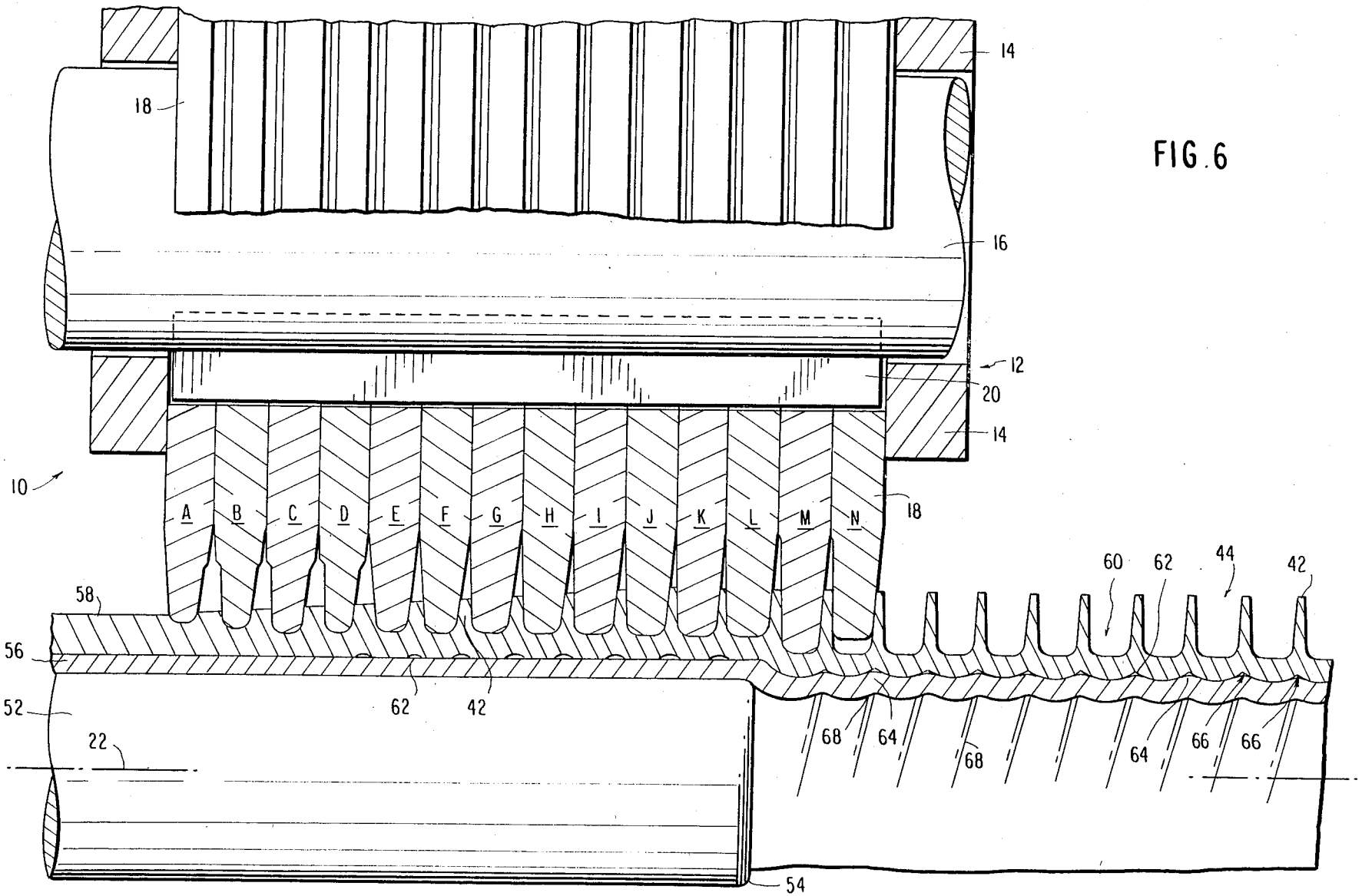
FIG. 6 is a partially cutaway side elevational view of the double wall heat exchanger being formed.

4. Y is the horizontal distance from side to side of each roller die at the height of the line on which are located the pivot points for the area made by the Rs (i.e., a line of centers for the Rs). See FIG. 7. All of roller dies 18 have a keyway depth of 3/32 inch. All of roller dies 18 are symmetric except for roller dies A, M and N—their asymmetric shapes are shown in FIG. 6. Each roller die has a thickness of 0.085 inch.

As outer tube 58 advances, the successive roller dies 18 push deeper groove (60) in the outer surface thereof and fins (42) begin to form therebetween. See FIGS. 6 and 8. As fin 42 is forming, small continuous helical groove 62 starts to form under fin 42—see between roller dies D and E in FIGS. 6 and 8. As the end of mandrel 52 is passed, longer roller die M forces inner tube 56 and the main web of outer tube 58 downwards. (The edge of mandrel 52 is rounded having a radius of 0.010 inches). Outer groove 60 becomes deeper giving fin 42 a height of 0.110 inch (with a top thickness of 0.010 inch and a bottom thickness of 0.022 inch). The top of fins 42 stays at the same level as and after inner tube 56 and outer tube 58 exit off of mandrel 52. The width of each groove 60 ends up being 0.067 inch.

Figure 8:
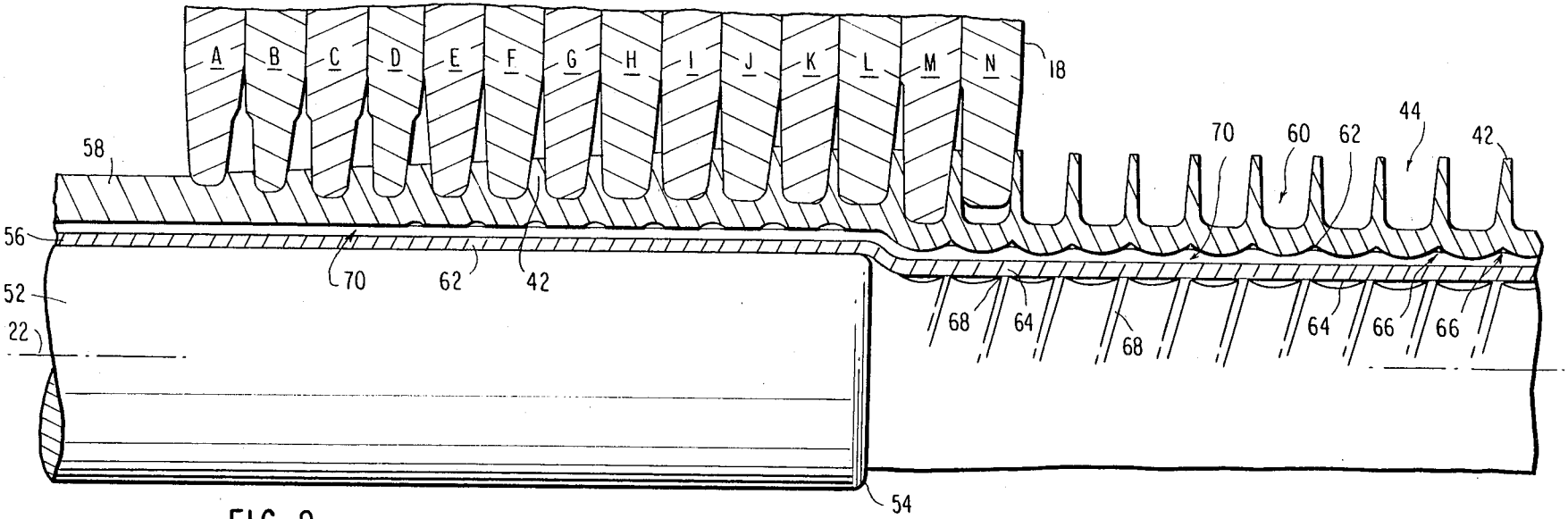
FIG. 8 is similar to FIG. 6, but is a partially cutaway side elevational view, along the center of the axial groove in the inner tube, of the double wall heat exchanger being formed.

As inner tube 56 exits off of mandrel 52, internal pressure forces it to conform to the shape and diameter of the bottom surface of outer tube 58, except in the area of inner tube 56 where axial groove tube 70 is located. The surface contact between inner tube 56 and outer tube 58 is 96 percent. Helical protrusion 64 in the top of inner tube 56 forms, except in the area of inner tube 56 where axial groove tube 70 is located. Continuous helical protrusion 64 moves into but does not completely fill inner helical groove 62 of outer tube 58. Helical protrusion 64 follows the path of helical groove 62. Thereby helical passageway 66 (annular space) forms between inner tube 56 and outer tube 58, and is continuing except where inner helical groove 62 of outer tube 58 passes over axial groove 70 of inner tube 56. Helical passageway has a height of 0.002 to 0.003 inch. As shown in FIG. 8, each end of each rotation of helical passageway communicates in an unrestricted manner with axial groove 70. Inner helical groove 68 is also formed on inner tube 58 (except in the region under axial groove 70) which follows the path of helical protrusion 64, but it presents a fairly smooth surface which causes little fluid flow pressure loss.)

The copper inner tube 56 and copper outer tube 58 were annealed at 1200° F. for 1½ hour. Roller dies 18 were cam driven and exerted pressures of greater than 500 to 1000 psig on the outer tube 58 and inner tube 56 during rolling. All of roller dies 18 have a cant angle of 2 degrees 15 minutes.

Figure 9:
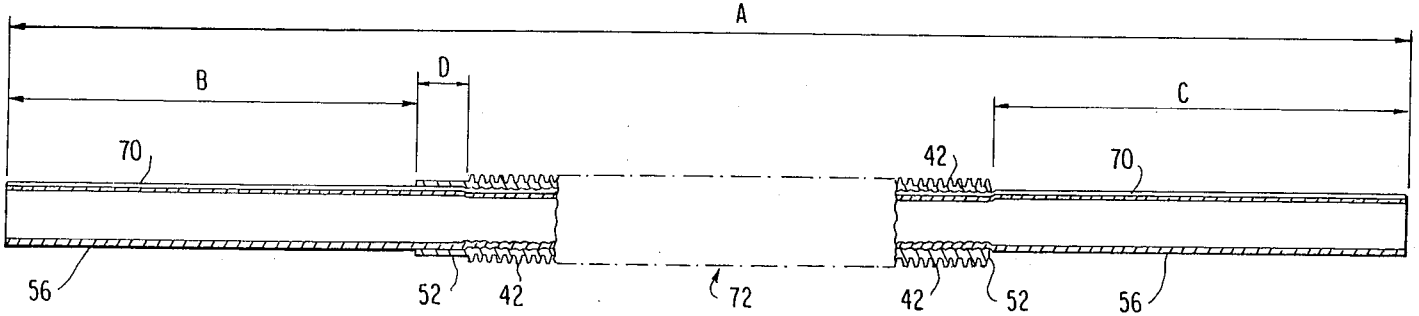
FIG. 9 is a side cross-sectional view, along the center of the axial groove, of the double wall heat exchanger of this invention.

FIG. 9 shows a particular double heat wall exchanger produced by the process of this invention. Double wall heat exchanger 72 has a length (A) of 16 feet 5 inches (i.e., inner tube 56). The uncovered left end (B) inner tube has a length of 4 inches, and the uncovered right end (C) of inner tube has a length of 6 inches. Left end (D) of outer tube 52 is unribbed (plain) and has a length of ½ inch. Inner tube 56 has an inside diameter of 0.500 inch and a wall thickness of 0.030 inch. Groove 70 in inner tube 56 has a depth of 0.015 inch and a thickness of 0.015 inch. The distance from the central axis of double wall heat exchanger 72 to the top of ribs 42 is 0.865 inch. The thickness of the non-ribbed portion of outer tube 52 is 0.028 inch.

What is claimed is:

1. Double wall tubing which comprising:

(i) an outer tube having an outer helical fin and a continuous, small helical groove on the inside of the outer tube, the helical groove following the helical path of the outer helical fin;

(ii) an inner tube (a) having a small continuous axial groove located on the outer perimeter of the inner tube and (b) having a slightly-raised helical protrusion which mates with the inner helical groove of the outer tube, the slightly-raised helical protrusion being comprised of a number of segments caused by the axial groove, each segment of the slightly-raised helical protrusion being uninterrupted; and (iii) a continuous, narrow helical passageway between the inner tube and outer tube formed by the mating continuous, small helical groove and the slightly-raised helical protrusion, said continuous, narrow helical passageway being unimpeded and extending from one end of said double wall tubing to the outer end thereof, the inner surface of the outer tube, except in the region of the inner, continuous, small helical groove thereof, contacting the outer surface of the inner tube, except in the region of the slightly-raised helical protrusion and in the region of the axial groove of the inner tube, the axial groove communicating with each end of each winding of the helical passageway.

2. Double wall tubing as claimed in claim 1 wherein said continuous, unimpeded helical passageway takes up 2 percent or less of the srface area of the outer surface of the inner tube.

3. Double wall tubing as claimed in claim 2, wherein said continuous, unimpeded helical passageway has a height of 0.002 to 0.003 inch.

4. Double wall tubing as claimed in claim 1 wherein said continuous, unimpeded axial groove has a width of 0.005 to 0.02 inch and a depth of 0.003 to 0.02 inch.

5. Double wall tubing with consists of:

(i) an outer tube having an outer helical fin and a continuous, small helical groove on the inside of the outer tube, the helical groove following the helical path of the outer helical fin;

(ii) an inner tube (a) having a small continuous axial groove located on the outer perimeter of the inner tube and (b) having a slightly-raised helical protrusion which mates which the inner helical groove of the outer tube, the slightly-raised helical protrusion being comprised of a number of segments caused by the axial groove, each segment of the slightly-raised helical protrusion being uninterrupted; and (iii) a continuous, narrow helical passageway between the inner tube and outer tube formed by the mating continuous, small helical groove and the slightly-raised helical protrusion, said continuous, narrow helical passageway being unimpeded and extending from one end of said double wall, tubing to the other end thereof, the inner surface of the outer tube, except in the region of the inner, continuous, small helical groove thereof, contacting the slightly-raised helical protrusion and in the region of the axial groove of the inner tube, the axial groove communicating with each end of each winding of the helical passageway.

6. A double wall heat exchanger for solar heaters and the like which comprises:

(i) an outer tube having an outer helical fin and a continuous, small helical groove on the inside of the outer tube, the helical groove following the helical path of the outer helical fin;

(ii) an inner tube (a) having a small continuous axial groove located on the outer perimeter of the inner tube and (b) having a slightly-raised helical protrusion which mates with the inner helical groove of the outer tube, the slightly-raised helical protrusion being comprised of a number of segments caused by the axial groove, each segment of the slightly-raised helical protrusion being uninterrupted; and (iii) a continuous, narrow helical passageway between the inner tube and outer tube formed by the mating continuous, small helical groove and the slightly-raised helical protrusion, said continuous, narrow helical passageway being unimpeded and extending from one end of said double wall heat exchanger to the other end thereof, the inner surface of the outer tube, except in the region of inner, continuous, small helical groove thereof, contacting the outer surface of the inner tube, except in the region of the slightly-raised helical protrusion and in the region of the continuous, unimpeded axial groove of the inner tube, the axial groove communicating with each end of each winding of the helical passageway.

7. Double wall heat exchanger as claimed in claim 6 wherein the inner tube is longer than the outer tube so as to provide uncovered end regions on the inner tube.

8. Double wall heat exchanger as claimed in claim 6 wherein the inner and outer tubes are made of annealed copper.

9. Double wall heat exchanger as claimed in claim 6 wherein said continuous, unimpeded helical passageway takes up 2 percent or less of the surface area of the outer surface of the inner tube.

10. Double wall heat exchanger as claimed in claim 9 wherein said continuous, unimpeded helical passageway has a height of 0.002 to 0.003 inch.

11. Double wall heat exchanger as claimed in claim 6 wherein said continuous, unimpeded axial groove has a width of 0.005 to 0.02 inch and a depth of 0.003 to 0.02 inch.

12. A double wall heat exchanger for solar heater and the like which consists of:

(i) an outer tube having an outer helical fin and a continuous, small helical groove on the inside of the outer tube, the helical groove following the helical path of the outer helical fin;

(ii) an inner tube (a) having a small continuous axial groove located on the outer perimeter of the inner tube and (b) having a slightly-raised helical protrusion which mates with the inner helical groove of the outer tube, the slightly-raised helical protrusion being comprised of a number of segments caused by the axial groove, each segment of the slightly-raised helical protrusion being uninterrupted; and (iii) a continuous, narrow helical passageway between the inner tube and outer tube formed by the mating continuous, small helical groove and the slightly-raised helical protrusion, said continuous helical passageway being unimpeded and extending from one end of said double wall heat exchanger to the other end thereof, the inner surface of the outer tube, except in the region of the inner, continuous, small helical groove thereof, contacting the outer surface of the inner tube, except in the region of the slightly-raised helical protrusion and in the region of the continuous, unimpeded axial groove of the inner tube, the axial groove communicating with each end of each winding of the helical passageway.

13. A solar heater which contains at least one double wall heat exchanger unit, each of the double wall heat exchanger unit comprising:

(i) an outer tube having an outer helical fin and a continuous, small helical groove on the inside of the outer tube, the helical groove following the helical path of the outer helical fin;

(ii) an inner tube (a) having a small continuous axial groove located on the outer perimeter of the inner tube and (b) having a slightly-raised helical protrusion which mates with the inner helical groove of the outer tube, the slightly-raised helical protrusion being composed of a number of segments caused by the axial groove, each segment of the slightly-raised helical protrusion being uninterrupted; and (iii) a continuous, narrow helical passageway between the inner tube and outer tube formed by the mating continuous, small helical groove and the slightly-raised helical protrusion, said continuous, narrow helical passageway beng unimpeded and extending from one end of said double wall heat exchanger to the other end thereof;

the inner surface of the outer tube, except in the region of inner, continuous, small helical groove thereof, contacting the outer surface of the inner tube, except in the region of the slightly-raised helical protrusion and in the region of the continuous, unimpeded axial groove of the inner tube, the axial groove communicating with each end of each winding of the helical passageway.

14. Solar heater as claimed in claim 13 wherein, in each of the double wall heat exchanger units, the inner tube is longer than the outer tube so as to provide uncovered end regions on the inner tube.

15. Solar heater as claimed in claim 13 wherein, in each of the double wall heat exchanger units, the inner and outer tubes are made of annealed copper.

16. Solar heater as claimed in claim 13 wherein, in each of the double wall heat exchanger units, said continuous, unimpeded helical passageway takes up 2 percent or less of the surface area of the outer surface of the inner tube.

17. Solar heater as claimed in claim 13 wherein, in each of the double wall heat exchanger units, said continuous, unimpeded helical passageway has a height of 0.002 to 0.003 inch.

18. Solar heater as claimed in claim 13 wherein, in each of the double wall heat exchanger units, said continuous, unimpeded axial groove has a width of 0.005 to 0.02 inch and a depth of 0.003 to 0.02 inch.

* * * * *